US005346103A

United States Patent [19]

Mizushima et al.

[11] Patent Number: 5,346,103

[45] Date of Patent: Sep. 13, 1994

[54] COMPRESSION SPRAYER FOR LIQUIDS

[75] Inventors: Hiroshi Mizushima; Tadao Saito; Takamitsu Nozawa, all of Tokyo, Japan

[73] Assignee: Yoshino Kogyosho Co, Ltd., Tokyo, Japan

[21] Appl. No.: 177,185

[22] Filed: Jan. 3, 1994

Related U.S. Application Data

[63] Continuation of Ser. No. 848,966, Apr. 24, 1992, abandoned.

[51] Int. Cl.[5] ..... B65D 88/54

[52] U.S. Cl. ..... 222/321; 222/380

[58] Field of Search ..... 222/321, 383, 378, 385, 222/380

[56] References Cited

U.S. PATENT DOCUMENTS 3,865,313 2/1975 Kondo ..... 222/321 X
4,640,443 2/1987 Corsette ..... 222/378 X

FOREIGN PATENT DOCUMENTS 51-131909 11/1976 Japan .
51-131910 11/1976 Japan .
63-185475 11/1988 Japan .

*Primary Examiner*—Gregory L. Huson
*Attorney, Agent, or Firm*—Oliff & Berridge

[57] ABSTRACT

A piston-cylinder liquid sprayer of long spraying time and simple construction has a long piston stroke and is adapted to spray liquid steadily without loosening. An erecting wall having an upper end portion engaged with an upper portion of a cylinder is attached to the outer surface of a container body neck portion. An erecting guide trunk is connected to the lower end of the erecting wall, and surrounds the erecting wall at a constant distance. A sliding trunk moves a piston upwardly and downwardly and is fitted into a gap between the erecting wall and the guide trunk. The sliding trunk is guided by the guide trunk, allowing the sliding trunk to be stably moved upwardly and downwardly, even if a longer stem is used.

10 Claims, 9 Drawing Sheets

COMPRESSION SPRAYER FOR LIQUIDS

This is a continuation of application Ser. No. 07/848,966 filed Apr. 24, 1992, now abandoned, which is a 371 of PCT/JP90/01998.

FIELD OF THE INVENTION

The present invention relates to a liquid sprayer wherein liquid cosmetic or liquid is discharged therefrom as it is or in a sprayed pattern.

BACKGROUND OF THE INVENTION

As an atomizer spraying liquid continuously, an aerosol-type liquid sprayer using Freon gas is often used. In such an aerosol-type liquid sprayer, Freon gas is pressurized in a container body, and by depressing the head of an upper end of a valve tube which is erected in an energized condition from an aerosol-type valve locked in the head portion of the container, the aerosol-type valve is opened, thereby spraying the liquid the container body out of a spraying aperture through the valve and the valve tube.

The aerosol-type liquid sprayer is very convenient because pressurized liquid is sprayed out of the opened valve only by depressing the valve tube of the aerosol-type valve. When Freon gas used for pressurization, however, is discharged in the atmosphere, it rises up to an ultra-high altitude and destroys the ozone layer, so that the development of a manual liquid sprayer capable of spraying continuously without using Freon gas is expected.

Speaking of liquid sprayers in general, an accumulator atomizer as disclosed in Utility Model Open No. 185475/88 is often used. In this accumulator atomizer, by energizing upwards and erecting a tubular member with its lower end provided with a small diameter trunk piston from a small diameter cylinder provided with a suction valve hanging into the container body, by fitting a large diameter trunk piston provided at the upper end of this member into a large diameter cylinder hanging from the lower surface of a depressing head, by forming a discharge valve of a valve body erecting from the upper end of the member and a valve hole drilled in the top wall of the large diameter cylinder, and by depressing said depressing head with respect to the container body, said tubular member is lowered against energization because of pressurization in the large diameter cylinder, thereby opening the discharge valve, and the liquid is sprayed out of the atomizing having an opening in the side face of the depressing head, and because of cancellation of the pressurization the tubular member and the depressing head are raised by said energization with the suction valve being closed when the depressing head is released, thereby opening the suction valve, and the liquid in the container body is sucked into the both cylinders and the tubular member.

Such a conventional accumulator atomizer has a relatively short spraying time, and the depressing head must be operated many times, which takes a great deal of trouble. Accordingly, it cannot replace said atomizer using Freon gas, and the construction thereof is also complicated.

The present invention made under these circumstances has as its object the provision of an atomizer which has a long spraying time and is constructed simple.

SUMMARY OF THE INVENTION

The present invention relates to a liquid sprayer comprising:

a container body provided with a neck portion erecting therefrom;

a cylinder hanging from said neck portion into the container body;

a suction valve provided at the lower end portion of this cylinder;

a suction pipe extending from this suction valve to the inner bottom of the container body;

an erecting wall having an upper end portion engaged with the upper portion of said cylinder, and being attached to the inner or outer surface of said neck portion;

an erecting guide trunk connected to the lower end of the erecting wall, and surrounding the erecting wall from outside with a constant distance therefrom;

a trunk piston up- and downwards movably fitted into said cylinder;

a stem erecting from this piston;

a connecting piece attached to the upper end of this stem;

a sliding trunk hanging from this connecting piece, and being up-and downwards movably fitted into the gap between said erecting wall 17 and guide trunk;

a head provided above said stem, and having a spraying aperture communicating with the interior of said stem, and a discharge valve provided in the upper portion of said stem.

And when the head is lifted up, both the head and the piston are lifted up, thereby generating a negative pressure, opening the suction valve, and sucking the liquid in the container body into the cylinder. When the head is depressed in this condition, the suction valve is closed and the discharge valve is opened by a depressed piston, thereby spraying the liquid in the cylinder out of the spraying aperture till the trunk piston reaches the lower limit thereof.

And since said sliding trunk is guided by the guide trunk, it can be operated steadily up- and downwards even if a longer stem is used.

In addition, a spring raising the piston may be provided.

As said discharge valve, an aerosol-type valve is preferably used having a valve tube connected to said head and being opened when the stem and the piston are depressed by depressing the head.

Said aerosol-type valve comprises preferably a valve body having upper and lower ends being opened; an elastic member having a first through-hole sealing the upper surface of the valve body; a casing having a second through-hole in alignment with said first through-hole and connecting the elastic member and the valve body to each other in one-piece construction by surrounding them; a valve tube having a closed lower end and an opened upper end to which said head is connected, and also having at the middle portion thereof an annular concave part with a valve hole drilled, the lower end thereof being inserted through the second through-hole of the casing and the first through-hole of the elastic member into the valve body and the elastic member being fitted into said annular concave part; and a spring energizing this valve tube upwards.

Said casing may be formed of a metallic sheet such as aluminum, a plastic casing, however, is preferably fitted onto the upper portion of said valve body.

Further, as another arrangement for accomplishing said object, a liquid sprayer of the following arrangement is also possible, comprising:

a container body provided with a neck portion erecting therefrom;

an outer trunk portion hanging into the container body, the upper end thereof being releasably attached to said neck portion;

an inward flange-like bottom wall attached to the lower end of said outer trunk;

an inner trunk erecting from this inward flange-like bottom wall and being located in the outer trunk;

a suction valve provided in the upper portion of this inner trunk;

a suction pipe hanging from the lower end of this inner trunk into the inner bottom of said container body;

a cylinder into which said inner trunk is water-tightly and up- and downwards movably fitted, and which is up- and downwards movably fitted between the inner and outer trunks;

a discharge valve provided at the upper end portion of this cylinder;

a head having a spraying aperture communicating with the interior of said cylinder via this discharge valve; and a spring energizing said cylinder downwards with respect to the inner trunk.

In this arrangement, as said discharge valve, an aerosol-type valve may be also used.

And when the head is lifted up with respect to the container body, the cylinder is raised, thereby generating a negative pressure, and the liquid in the container body flows through the suction valve into the cylinder. Subsequently, when the head is released, the liquid in said cylinder is pressurized since the cylinder is being energized downwards by the spring. When the depressing head 37 is depressed in this condition, the discharge valve is opened by a depressed piston, thereby spraying the liquid in the cylinder out of the spraying aperture. When the head is released, the discharge valve is closed, and spraying is stopped while when the head is kept depressed, spraying is continued till a operating member 20 reaches the lower limit thereof as illustrated.

And since said sliding trunk is guided by the guide trunk, it can be operated steadily up and down even if a longer stem is used.

BRIEF DESCRIPTION OF THE DRAWINGS

FIG. 1 is a longitudinal sectional view of the atomizer of the present invention wherein the member provided with a piston is depressed with respect to the container body, and FIG. 2 is a longitudinal sectional view of the atomizer of the present invention wherein the member provided with a piston is lifted up with respect to the container body.

FIG. 4 is a half sectional view of the atomizer of the present invention, and FIG. 5 is a half sectional view of the aerosol-type valve member used in the atomizer.

DETAILED DESCRIPTION OF THE PREFERRED EMBODIMENTS

Figure 1:
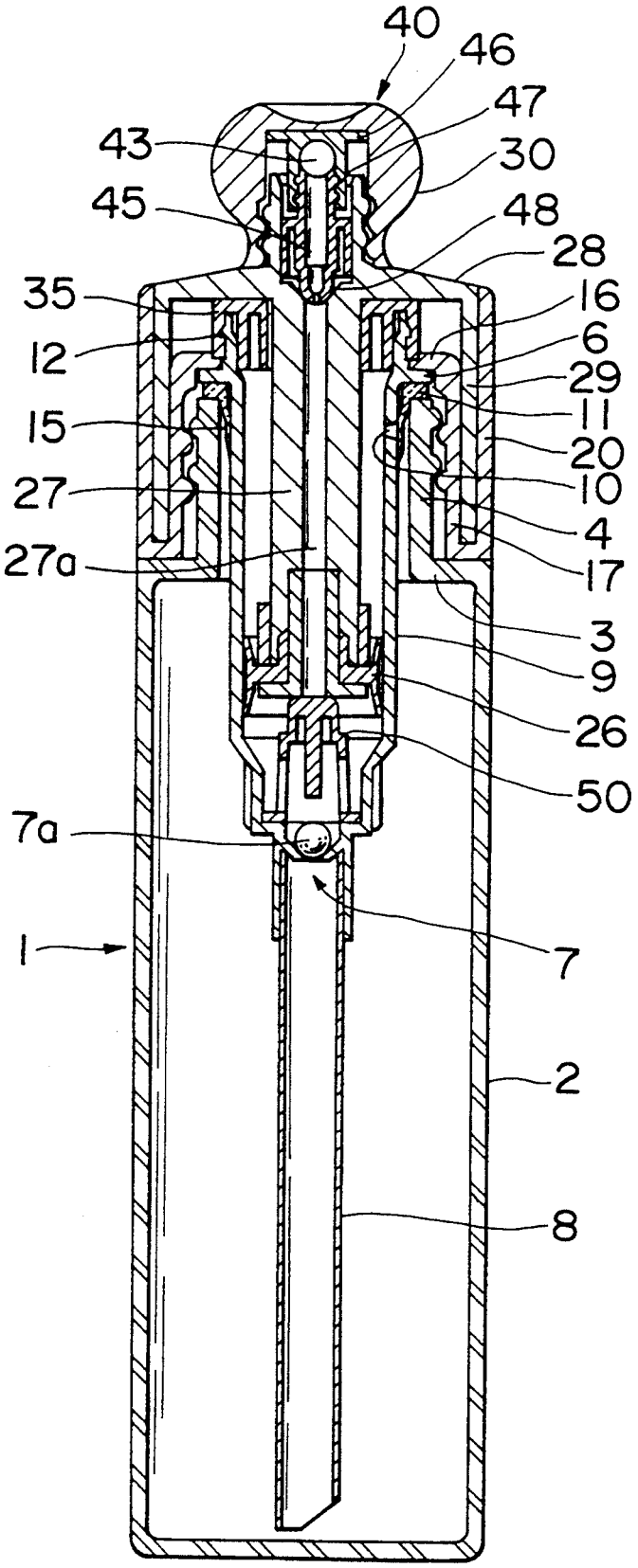
FIGS. 1 and 2 illustrate Example 1 of the present invention.

Referring now to the drawings, the preferred embodiments of the present invention will be described.

Figure 2:
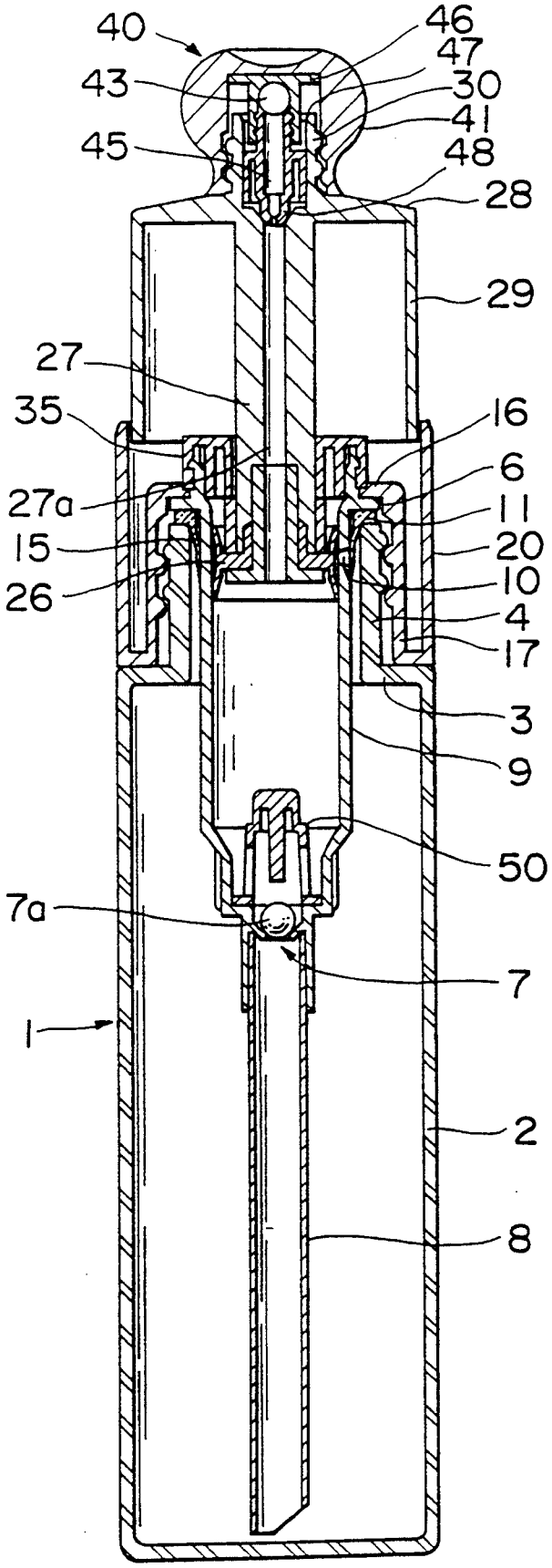

In Example 1, as illustrated in FIGS. 1 and 2, the liquid sprayer comprises a container body 1 provided with a neck portion 4 erecting therefrom; a cylinder 9 hanging from said neck portion 4 into container body 1 and defining a longitudinal direction and a radial direction; a suction valve 7 provided in the inner lower end of this cylinder 9; a suction pipe 8 extending from this suction valve 7 to the inner bottom of the container body 1; an erecting wall 17 having an upper end portion engaged with the upper portion of said cylinder 9, and being attached to the outer surface of said neck portion 4; an erecting guide trunk 20 connected to the lower end of the erecting wall 17, and surrounding the erecting wall 17 from outside with a constant distance therefrom; a trunk piston 26 up- and downwards movably fitted into said cylinder 9; a stem 27 erecting from this piston 26; a connecting piece 28 attached to the upper end of the stem 27; a sliding trunk 29 hanging from this connecting piece 28, and up- and downwards movably fitted into the gap between said erecting wall 17 and guide trunk 20; a head 40 provided above said stem 27, and having a spraying aperture 43 communicating with the interior of said stem 27; and a discharge valve 45 provided in the upper portion of said stem 27.

As is clear from FIG. 1, for example, neck portion 4 is disposed radially outwardly from cylinder 9, erecting wall 17 is disposed radially outwardly from neck portion 4, sliding trunk 29 is disposed radially outwardly from erecting wall 17, and guide trunk 20 is disposed radially outwardly from sliding trunk 29.

In the following, Example 1 will be described in detail:

In FIGS. 1 and 2, 1 is a container body 1 provided with a neck portion 4 erecting via a barrel portion 2 and a shoulder portion 3 therefrom, and the neck portion 4 has threads on the outer surface thereof.

In the container body 1 a cylinder 9 is provided, hanging from the neck portion 4. This cylinder 9 has a first outward flange 6 at the upper end thereof, and by engaging this outward flange 6 with the upper end of said neck portion 4, the cylinder 9 is hung into the container body 1.

This cylinder 9 has a suction valve 7 in the lower end portion thereof, and a suction pipe 8 extending from this suction valve 7 to the inner bottom portion of the container body 1 is also attached. The cylinder 9 has an outer diameter smaller than the inner diameter of the neck portion 4, and has a through-hole 10 at the upper portion thereof, preventing a negative pressure in the container body 1.

As for an arrangement not illustrated, an elastic thin trunk portion 15 is hung from the inner periphery of a packing 11 clamped between the top surface of the container body 1 and the lower surface of the first outward flange 6 of the cylinder 9, and by fitting this thin trunk portion 15 into the upper portion of the cylinder 9, said through-hole 10 is sealed, thereby allowing outside air to flow in only when there is a negative pressure in the container body 1 as a result of decrease of an amount of the liquid.

Meanwhile, an erecting wall 17 is threaded on the outer surface of the neck portion 4 of the container body 1. This erecting wall 17 has an inward flange 16 at the upper end thereof, and this inward flange 16 and the upper end surface of the neck portion 4 clamp the outward flange 6 therebetween by means of said packing 11, thereby securing said cylinder 9.

And a guide trunk 20 is erected from the lower end of the erecting wall 17 by means of a gap retaining plate 18. This guide trunk 20 surrounds the erecting wall 17 from outside, erecting with a constant distance from the erecting wall 17.

In addition, a trunk piston 26 is up- and downwards movably fitted into said cylinder 9. This trunk piston 26 has a communicating hole at the middle portion thereof, and a stem 27 is erected, communicating with this communicating hole. To the upper end of the stem 27 an outward flange-like connecting piece 28 is attached, and a sliding trunk 29 is hung from the outer periphery of the connecting piece 28, and is up- and downwards movably fitted into the gap between said erecting wall 17 and guide trunk 20.

A fitting trunk 30 is also erected from the inner periphery of said outward flange-like connecting piece 28.

As for the example illustrated, a short trunk 12 which must be engaged is erected from the upper surface of the inner periphery of the outward flange 6 of said cylinder 9, and said stem 27 is inserted into a second guide trunk 35 which is fitted into this short trunk 12.

Besides, a head 40 is fitted into the upper end of said stem 27. This head 40 has a shape of cap and is provided with a spraying aperture 43 on one side of the upper portion thereof. This spraying aperture 43 is constructed so as to spray liquid in an atomized pattern.

The inner surface of the upper end of a stem hole **27*a* drilled in said stem 27 is sealed by means of a discharge valve 45. In the example illustrated, a retaining trunk 47 having a through-hole communicating with the spraying aperture 43 is hung from a top plate 46 fitted into the upper portion of said head 40, and an elastic trunk portion 48 is in contact with the upper end surface of the stem 27 having a tapered outer peripheral lower surface at its bottom portion, the upper trunk portion thereof being fitted into this retaining trunk 47**, the lower surface thereof being of spherical surface, and the bottom portion thereof having a slit as liquid passage.

A member 50 for preventing blind movements of a ball valve **7*a* of the suction valve 7 is fitted into the bottom portion of the cylinder 9**.

And when the head is lifted up, the piston 27 is raised in the cylinder 9, thereby generating a negative pressure in the cylinder 9 below the piston 26, opening the suction valve 7, and sucking the liquid in the container body 1 through the suction pipe 8 into the cylinder 9.

Subsequently, when the head 40 is depressed, the suction valve 7 is closed, and the discharge valve 45 is opened by the pressurized liquid in the cylinder 9 below the piston 26 because the liquid has no place to escape, thereby spraying the liquid out of the spraying aperture 43.

In this example having the above-described arrangement, since spraying is adapted to be carried out by lifting up the head 40 and the piston 26 with respect to the cylinder 9, and depressing them thereafter, a longer spraying time can be ensured by using the cylinder 9 and the stem 27 of appropriate lengths. And since the sliding trunk 29 connected to the stem 27 is hung so that the sliding trunk 29 may be moved up- and downwards between the erecting wall 17 and the guide trunk 20, the trunk piston 26 and the member connected thereto will not be loose with respect to the cylinder when lifted up, even if the stroke of the trunk piston 26 with respect to the cylinder 9 becomes large, thereby realizing a smooth spraying.

Figure 3:
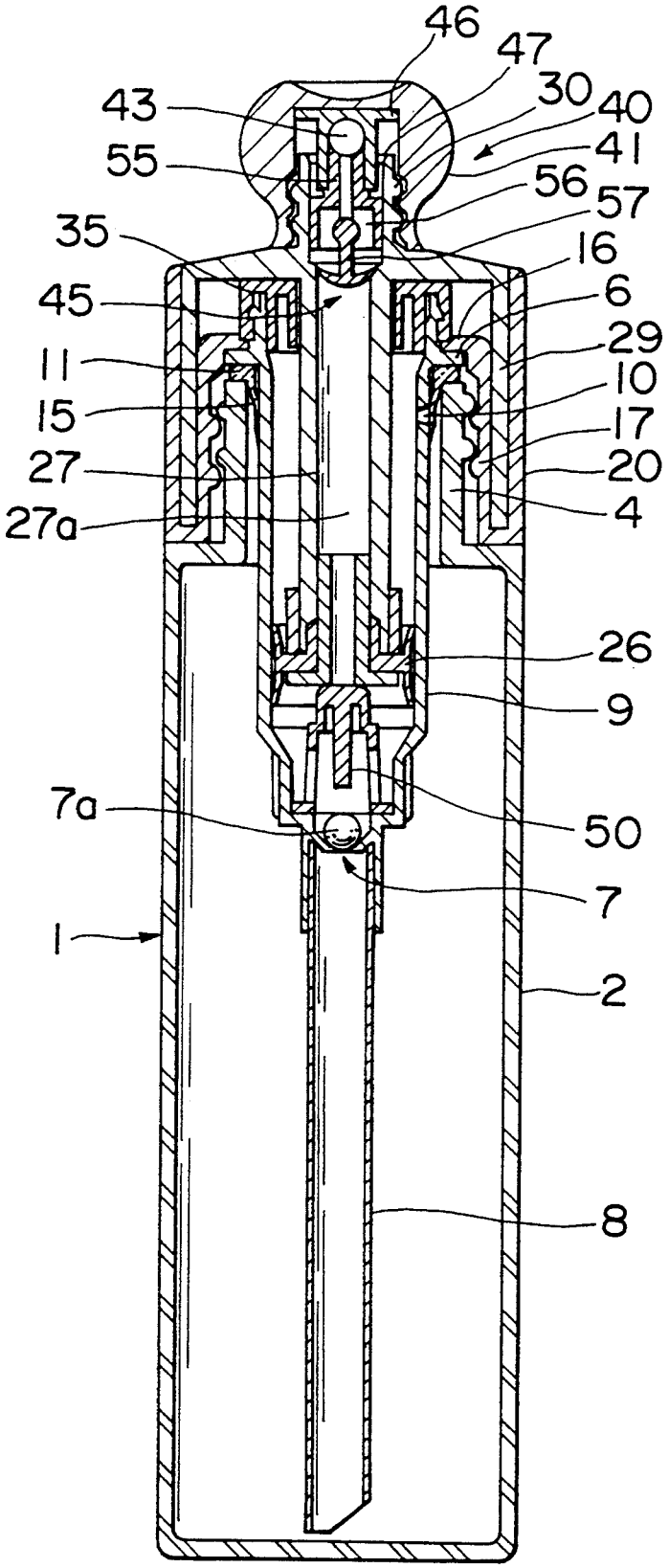
FIG. 3 illustrates Example 2 of the present invention, and is a longitudinal sectional view of the atomizer of the present invention wherein the member provided with a piston is depressed with respect to the container body.

In Example 2 illustrated in FIG. 3, an upper half of a clamping trunk 55 having a larger diameter whose lower half is fitted into a retaining trunk 47 with a through-hole, as illustrated in Example 1, hung from the top surface 46 of a discharge valve 45 fitted into the upper portion of the peripheral wall 41 of a head 40, the upper portion of a valve body 57 of anchor-shaped section is supported from the inner surfaces of a plurality of clamping plates 56 attached to the inner surface of the lower half of the clamping trunk 55, and the upper end surface of a stem hole **27*a*** is sealed by the lower surface of a spherical surface portion formed of this lower portion of the valve body.

This example has similar advantages as in the proceeding example.

Figure 4:
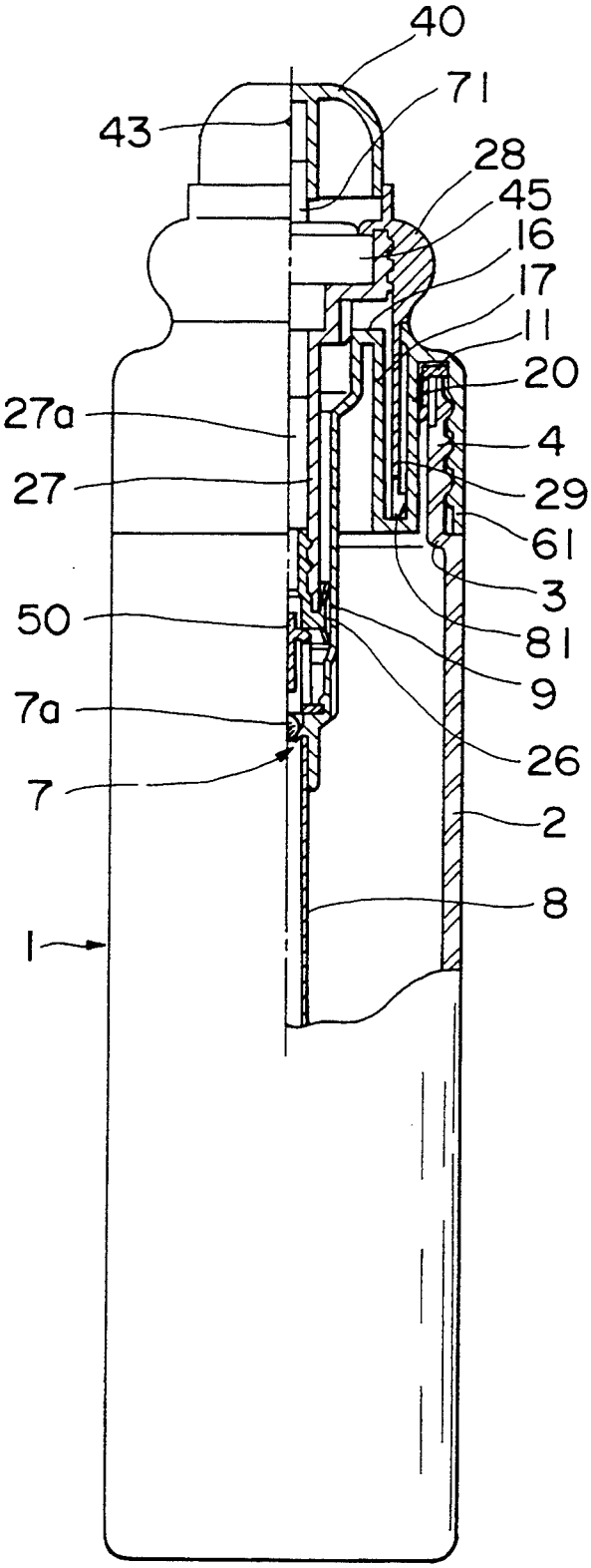
FIGS. 4 and 5 illustrate Example 3 of the present invention.

As illustrated in FIG. 4, this example has a similar arrangement as Example 1. In Example 1, however, an erecting wall 17 is threaded on the neck portion 4, while in this example an erecting wall 17 is located in the neck portion 4. In addition, an erecting guide trunk 20 connected to the lower end of the erecting wall 17, and surrounding the erecting wall 17 from outside with a constant distance therefrom is located outside of the neck portion 4 in Example 1, while in this example it is located in the neck portion 4.

And a threaded trunk is connected to the upper end of the guide trunk 20 and is hung therefrom. This threaded trunk is adapted to be threaded to said neck portion 4.

Figure 5:
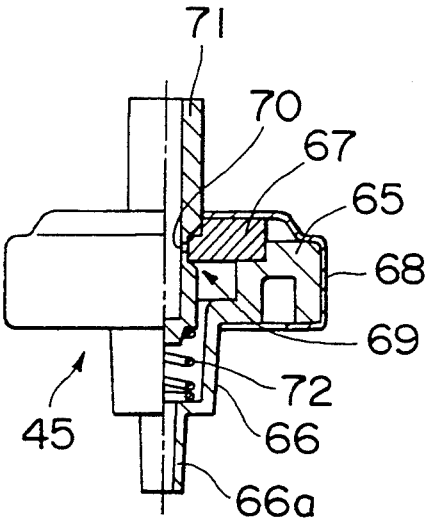

A trunk piston 26 is up- and downwards movably fitted into said cylinder 9. From the piston a stem 27 is erected, into the larger diameter upper portion of which an aerosol-type valve 45 having a depressing head is fitted. In one example of this valve illustrated in FIG. 5, a valve body 66 having an outward flange 65 and an elastic member 67 having a first through-hole and sealing the upper surface of the valve body 66 are enveloped in a metallic casing having a second through-hole, and are connected to each other in one-piece construction, and at the same time a valve tube 71 with a closed lower end surface having an annular concave part with a valve hole 70 drilled at the middle portion thereof is inserted through said first and second through-holes, the elastic member is fitted into the annular concave part, said valve hole 70 is sealed by means of the inner wall surface of the through-hole of this elastic member 67, the valve tube 71 is energized upwards by means of a spring 72, and a discharge valve is formed of the valve hole 70 and the elastic member 67. When a head 40 with a spraying aperture 43 is fitted into the upper end of the valve tube 71, and when the head 40 is depressed against energization, the peripheral portion of the first through-hole of the elastic member 67 is bent downwards due to the lowered valve tube 71, thereby opening the valve hole 70, and when the valve tube 71 is raised due to the interruption of depression, the elastic member 67 is also elastically returned to the illustrated position, thereby sealing said valve hole 70.

In case of an aerosol-type liquid sprayer, the upper end of an outflow pipe is fitted into the trunk portion 66*a* hanging from the inner periphery of the inward flange-like bottom wall of the valve body 66, and the outflow pipe is hung into the container body 1, while the outflow pipe is not required in this example.

A trunk-like connecting piece 28 projecting outwards at the periphery thereof is fitted into the upper end portion of said valve 45 or stem 27, a sliding trunk 29 is hung into this connecting piece 28, and the sliding trunk 29 is up- and downwards movably fitted into said guide trunk 20.

At its lower end this sliding trunk 29 is provided with a plurality of split grooves 81 having an opened lower surface, and in addition, an engaging projection is provided at the outer edge of the lower end of the sliding trunk 29, and this projection is engaged with a convex part at the inner surface of the upper end of the guide trunk 20 when the operating member is lifted up, thereby preventing the operating member from slipping out.

In this example, due to the aerosol-type valve 45 fitted, the stem 27 and the piston 26 are depressed simultaneously with the opening of the aerosol-type valve 45 when depressing the head for spraying liquid, thereby enabling the pressurized liquid in the cylinder 9 to be sprayed powerfully, on the other hand, when spraying is stopped before the piston 26 does not reach the lower limit thereof, in particular, an aerosol-type valve member 45 constructed so as to block up said valve hole 67 by means of the inner wall surface of the first through-hole of the elastic member 67 closes the valve immediately, thereby enabling liquid spraying to be stopped without dripping.

As for the similar parts as in Example, the description thereof is omitted with the same symbols being affixed.

Figure 6:
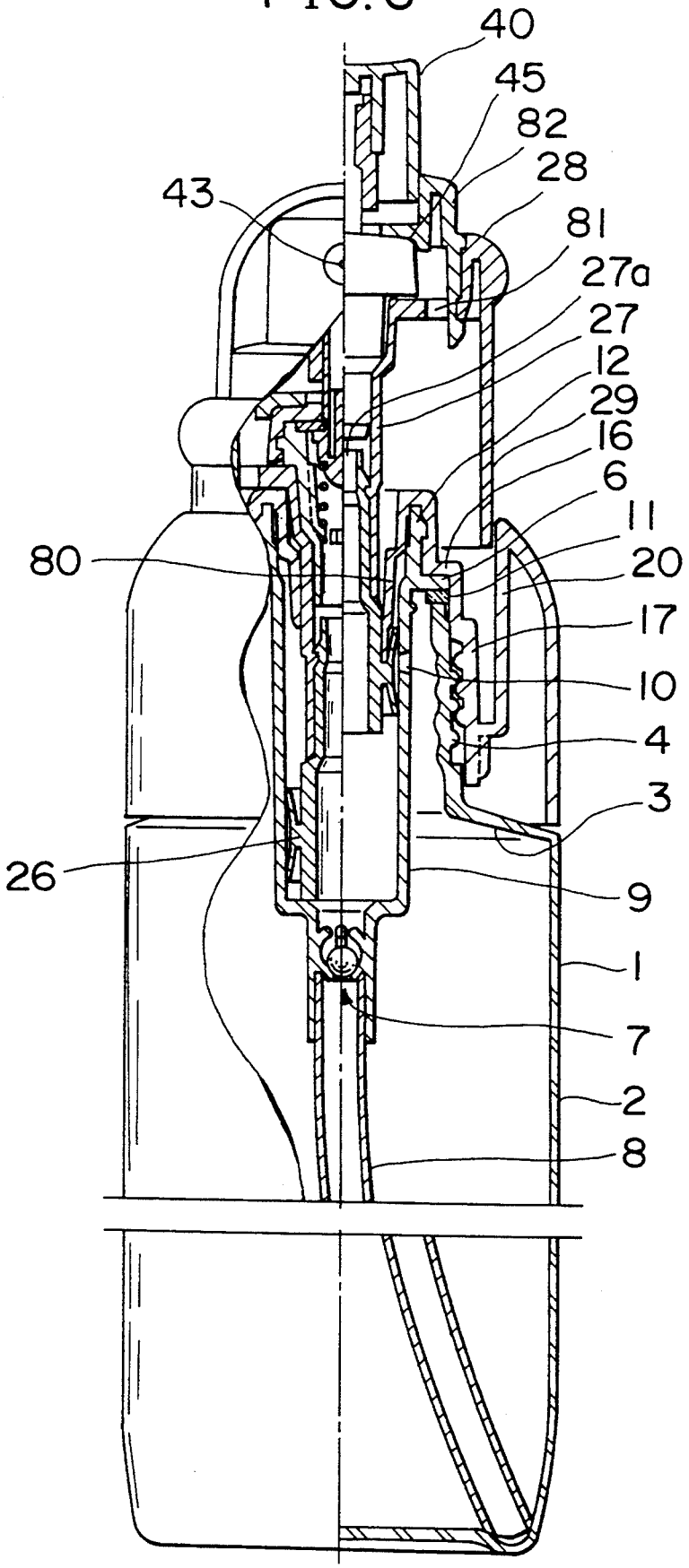
FIG. 6 is a sectional view illustrating Example 4.
Figure 7:
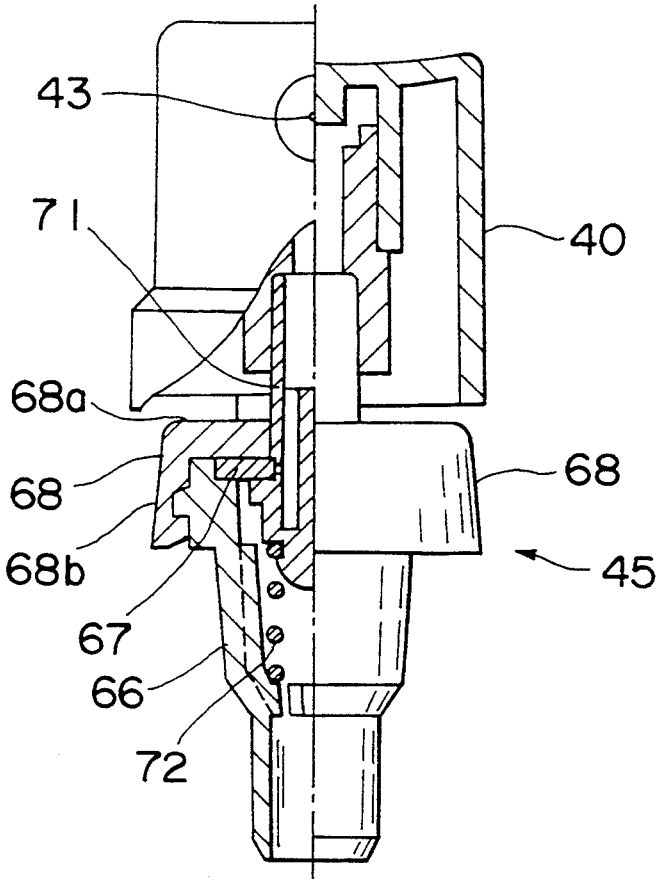
FIG. 7 is a sectional view of the aerosol-type valve member used in Example 4.

As illustrated in FIG. 6, Example 4 is identical with Example 1 in that an erecting wall 17 is located outside of the neck portion 4 and threaded on the neck portion 4, and with Example 3 in that an aerosol-type valve is provided.

Example 4 is, however, different from Examples 1 and 3 in the following:

In Example 4, the erecting wall 17 has an inward flange 16 at the upper end thereof, an outward flange 6 is clamped via said packing 11 between this inward flange 16 and the upper end surface of the neck portion 4, thereby securing said cylinder 9. In this point Example 4 is identical with Example 1, in this example, however, the erecting wall 17 has also an engaging trunk 80 as one-piece construction erecting from the inner peripheral edge of the inward flange 16, extending over the short trunk 12 at the upper portion of the cylinder 9, and hanging into the cylinder 9. This engaging trunk 80 has an lower end adapted to be disengaged from said piston 26, thereby determining the upper limit of the stroke of the piston 26. And since these engaging trunk 80 and erecting wall 17 are constructed in one-piece, the second guide trunk 35 provided in Example 1 is not required any more.

And this example is also identical in Example 1 and 3 in that an outwards flange-like connecting piece 28 is attached to the upper end of the stem 27, and that a sliding trunk 29 is hung from the outer periphery of said connecting piece 28, it is, however, different from Examples 1 and 3 in that these stem 27, connecting piece 28 and a sliding trunk 29 are molded from plastics In one-piece construction. An engaging hole 81 is provided in the connecting piece 28, and by means of a trunk-like fixture 82 installed on the upper surface of the stem 27 from above by suspending the nail part of the lower end thereof at the edge portion of this engaging hole 81, said aerosol-type valve 45 is fixed to the upper surface of the stem 27.

As described above, the number of component parts can be decreased due to the omission and one-piece construction of some parts, thus realizing a decreased production cost.

As for the aerosol-type valve 45 used in this Example 4, a trunk-like valve body 66, the upper half of which is of larger diameter than the lower half, and an elastic member 67 with a first through-hole seal the upper surface of the valve body 66 are enveloped in a plastic casing 68 with a second through-hole, and are connected to each other in one-piece construction. That is, the plastic casing 68 is constructed so as to erect a side wall portion 68*b* around a top plate portion 68*a* having the second through-hole in the middle and to provide a concave groove in the interior of the side wall portion 68*b*, and it is fitted into the trunk-like valve body 66 by fitting a convex groove provided on the upper outer periphery of the trunk-like valve body 66 into this concave groove. And a valve tube 71 with a closed lower end surface having an annular concave part with a valve hole 70 drilled at the middle portion thereof is inserted through the second through-hole of said plastic casing 68 and the first through-hole of said elastic member 67, the elastic member 67 is fitted into the annular concave part, said valve hole 70 is sealed by the inner wall surface of the through-hole of the elastic member 67, and the valve tube 71 is energized upwards by means of a spring 72 provided in the trunk-like valve body 66. Thus, a discharge valve is formed of the valve hole 70 and the elastic member 67. When a head 40 with a spraying aperture 23 is fitted into the upper end of the valve tube 71, and the head 40 is depressed against energization, the peripheral portion of the first through-hole of the elastic member 67 is bent downwards due to the lowered valve tube 71, thereby opening the valve hole 70, and when the valve is raised due to the interruption of depression, the elastic member 67 is also returned elastically to the illustrated position, thereby blocking up said valve hole 70.

Unlike the valve 45 in Example 3 using a metallic casing, the valve in this Example uses a plastic casing, thus allowing the casing 68 to be fitted onto the valve body 66 much more easily than in Example 3 wherein the metallic casing is fixed by caulking.

In addition, in Example 4, an ordinary packing 11 without a thin trunk portion 15 is used in stead of the packing with a thin trunk portion 15 in Example 1. Since other constructions are similar to Examples 1 and 3, the description thereof is omitted with the same symbols being affixed.

Figure 8:
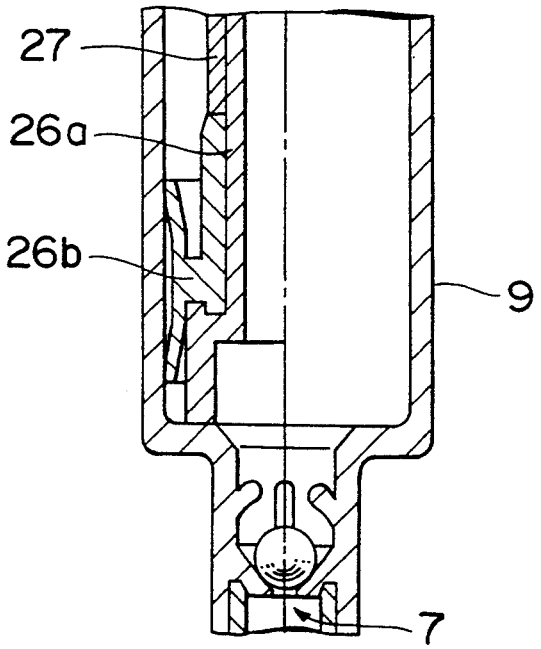
FIG. 8 illustrates an example of the piston portion the design of which has been changed.
Figure 9:
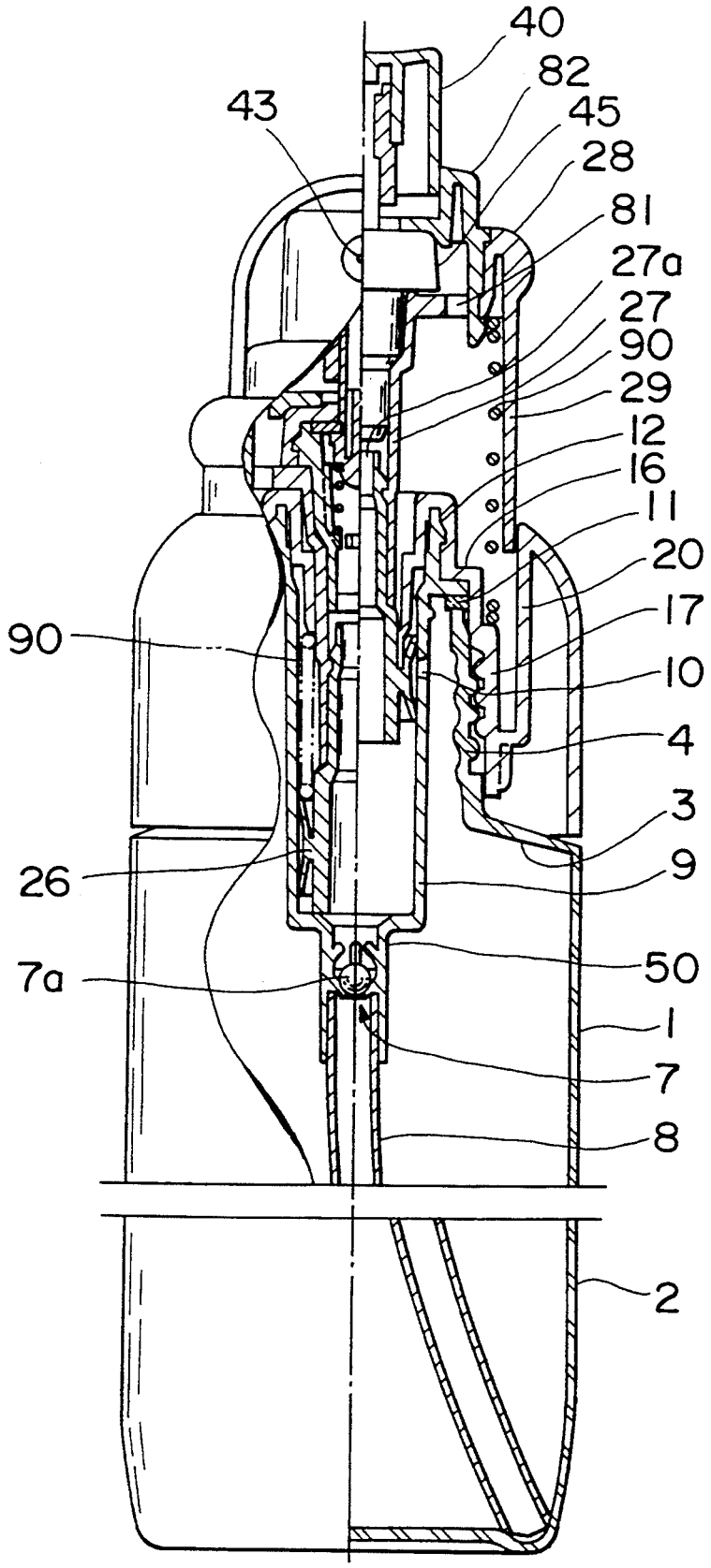
FIG. 9 is a sectional view illustrating Example 5.

As illustrated in FIG. 8, the piston 26 may be divided into a trunk portion 26*a* connected to the stem 27 and a piston body 26*b*, and the piston body 26*b* may be clamped between this trunk portion 26*a* and the stem 27. In this arrangement the piston body 26*b* can be replaced easily according to cylinder diameters.

in Example 5, as illustrated in FIG. 9, a spring 90 is located between the erecting wall 17 portion and the connecting piece in Example 4, the piston 26 is energized together with the head 40 and the stem 27 by means of the spring 90 so as to be kept always in a raised position. Thus, a through-hole 10 for preventing a negative pressure in the container body 1 is sealed by the piston when the liquid sprayer is not in use, thereby preventing liquid from leaking out of this through-hole 10 if the thin trunk portion 15 is not used.

As illustrated with a dot-lash line in FIG. 9, the spring 90 may be stretched between the engaging trunk 80 and the piston 26.

Thus, by energizing the piston 26 together with the head 40 and the stem 27 by means of the spring 90 so as to kept it always in a raised position, no operation for lifting up the head 40 is required in case of repeated spraying operations, thereby realizing an easy operation. When this spring 90 is used, mean for locking the head 40 in a depressed condition in carrying the container or so may be provided. As an example thereof, the outer surface of the sliding trunk 29 may be provided with a projection, and the inner surface of the guide trunk 20 may be provided with a longitudinal groove into which the projection of the sliding trunk is inserted and a horizontal groove connected to the lower end of this longitudinal groove, and by depressing the head 40, the projection may be displaced from the longitudinal groove into the horizontal groove so as to lock thehead 40 and the stem 27.

Figure 10:
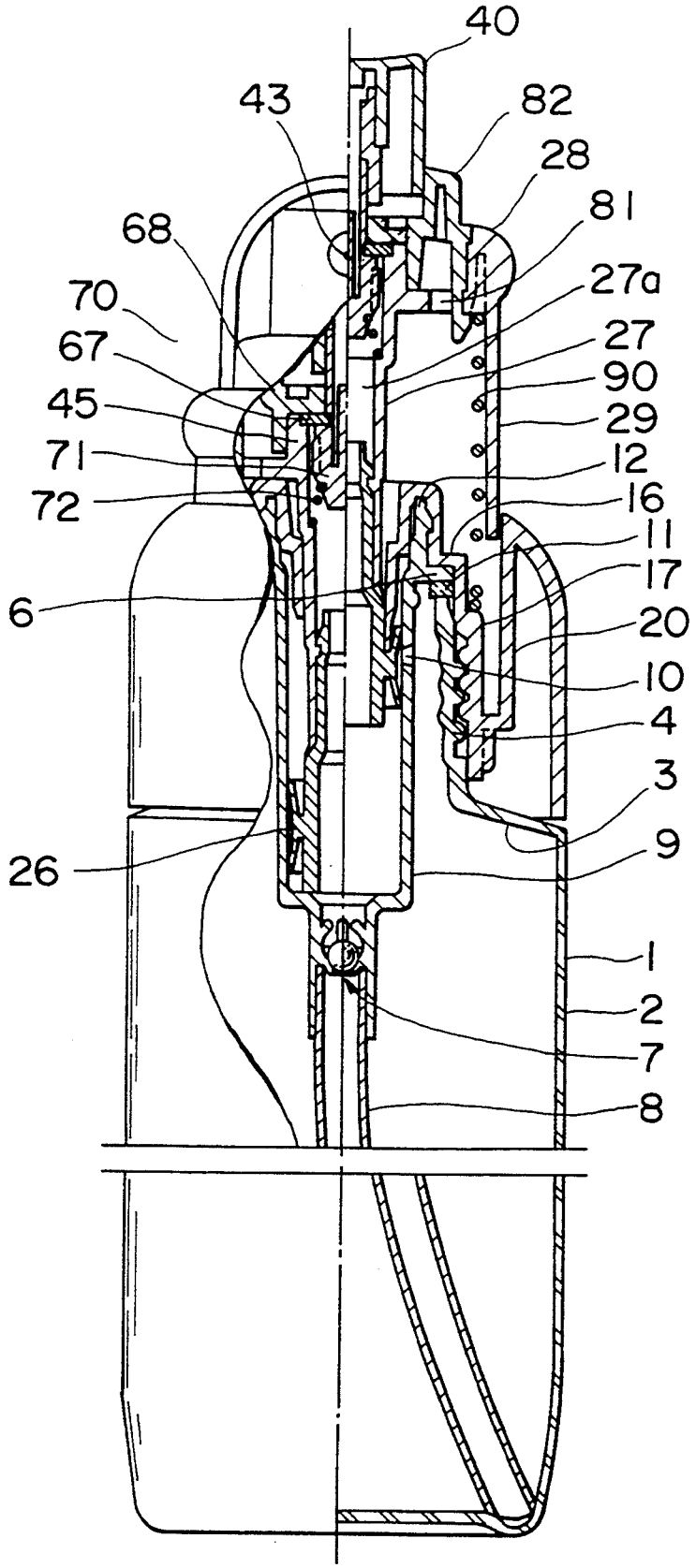
FIG. 10 is a sectional view illustrating Example 6, FIG. 11 a longitudinal sectional view of the atomizer of the present invention.

In this example, as illustrated in FIG. 10, the aerosol-type valve 45 in Example 5 is incorporated in the stem 27, wherein the trunk-like valve body 66 is constructed as a member forming a portion of the stem 27 in one-piece, the plastic casing 68 is fitted onto the stem 27, the elastic member 67 with a first through-hole is provided at the upper portion of the stem 27, the valve tube 71 with a closed lower end surface having an annular concave part with a valve hole 70 drilled is inserted through the second through-hole of said plastic casing 68 and the first through-hole of said elastic member 67, the elastic member 67 is fitted into the annular concave part, said valve hole 70 is sealed by the Inner wall surface of the first through-hole of the elastic member 67, and the valve tube 71 is energized upwards by means of the spring 72 engaging a stepped part provided in the stem 27. Since said plastic casing 68 is constructed in one-piece with said trunk-like fixture 82 the tip of which is inserted into the engaging hole 81 provided in said connecting piece 28 and is engaged therein, the number of component parts is decreased so much.

In this arrangement, the number of component parts can bedecreased, thus realizing an easier mass production and a decreased production cost.

Figure 11:
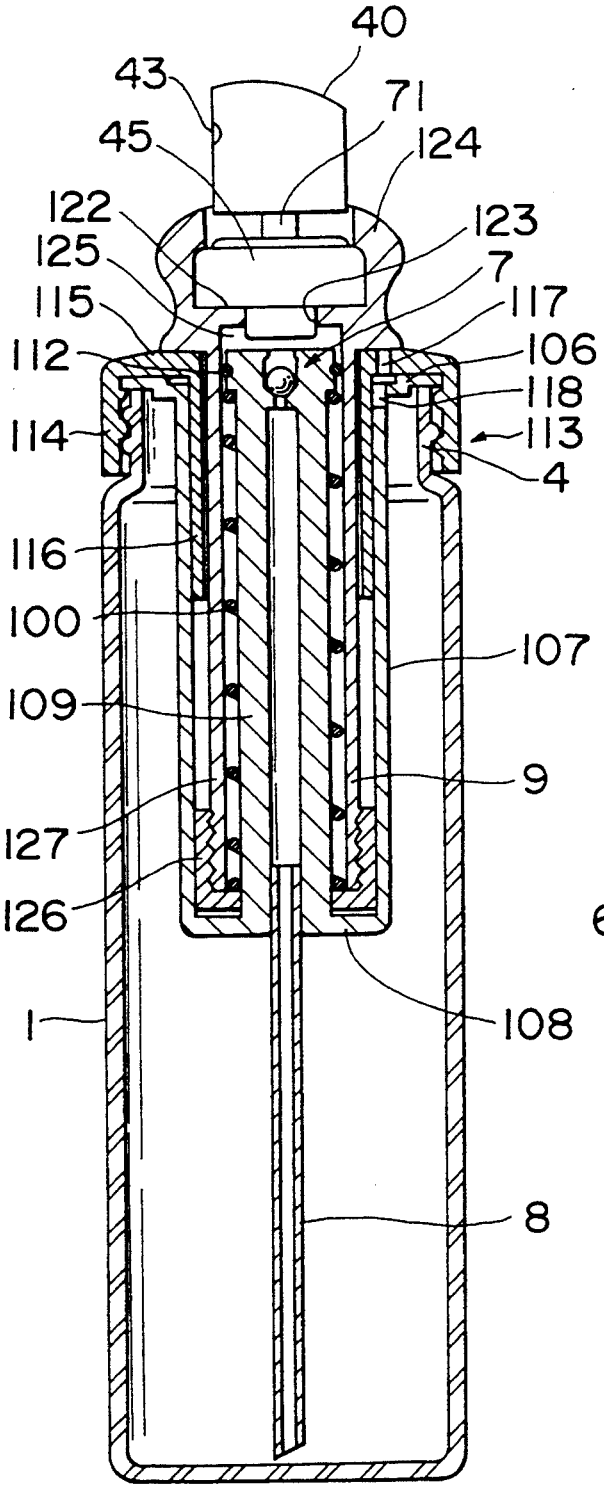
Figure 12:
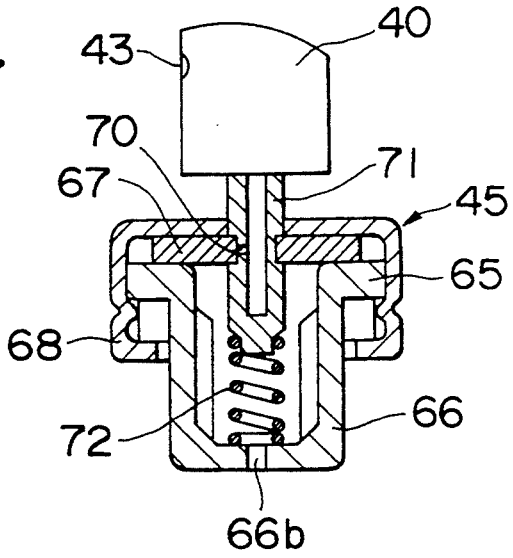
FIG. 12 is a longitudinal sectional view of the aerosol-type valve used in the atomizer.

Apparatus in this example is, as illustrated in FIGS. 11 and 12, a liquid sprayer comprising: a container body 1 provided with a neck portion 4 erecting therefrom; an outer trunk portion 107 the portion of which is releasably attached to said neck portion 4 and which is hung into the container body 1; an inward flange-like bottom wall 108 attached to the lower end of said outer trunk portion; an inner trunk portion 109 erecting from this inward flange-like bottom wall 108 and being located in the outer trunk portion 107; a suction valve 7 provided in the upper portion of this inner trunk portion 109; a suction pipe 8 hanging from the lower end of this inner trunk portion 109 into the inner bottom of said container body 1; a cylinder 9 into which said inner trunk portion 109 is up- and downwards movably fitted and which is water-tight and up- and downwards movably fitted between the inner and outer trunk portions; a discharge valve 45 provided at the upper end portion of this cylinder 9; a head 40 having a spraying aperture 43 communicating with the Interior of said cylinder 9 via this discharge valve 45; and a spring 100 energizing said cylinder 9 downwards with respect to the inner trunk portion 109.

In the following, Example 7 will be described in detail:

In FIG. 11, 1 is a container body 1 povided with a neck portion 4 erecting therefrom.

In the container body 1 an outer trunk portion 107 is provided, hanging from the neck portion 4. This outer trunk portion 107 has an outward flange 106 at the outer periphery of the upper end thereof, engaging with the upper end surface of said neck portion 4. And by covering the outward flange 106 with a fixing trunk threaded on this neck portion 4, the outer trunk portion is fixed in the neck portion 4. An inward flange-like wall 115 is projected from the upper end of the peripheral wall 114 of the fixing trunk 113 threaded to the outer surface of the neck portion 4, and a trunk portion 116 fitted into the outer trunk portion 7 is hung from the inner periphery of this inward flange-like wall 115. In addition, in one part of the inner surface of the inward flange-like wall 115 and at the upper end portion of the outer trunk portion 107 therebelow are drilled outside air suction holes 117 and 118 respectively, communicating with each other. It is also possible not to attach the fixing trunk 113, but to hang a peripheral wall from the outer periphery of the outward flange 106 and to screw this peripheral wall on the neck portion 4.

Besides, an inward flange-like bottom wall 108 is provided inside the lower end of the outer trunk portion 107, and an inner trunk portion 109 is provided, erecting from the inner periphery of this inward flange 108.

And a suction valve 7 is provided in the upper portion of inner trunk portion 109, and in addition, a suction pipe 8 extending from the lower portion of the inner trunk portion 109 to the inner bottom portion of the container body 1 is hung.

The upper portion of inner trunk portion 109 may be larger in diameter than the lower portion thereof, and an O-ring 112 may be fitted thereon.

Between said inner trunk portion 109 and outer trunk portion 107, the cylinder 9 is fitted up- and downwards movably. The upper end surface of this cylinder 9 is sealed by means of top wall 122, and this top wall has an opening 123 at the middle portion thereof, and at the same time a peripheral wall 124 erecting from the outer periphery of the top wall is provided. The outer periphery of the top wall projects not only from the upper end of the cylinder 9 like an outward flange, but also seals the outside air suction hole 117 of said fixing trunk 113 by means of the lower surface of the outward flange-like portion. The cylinder 9 is water-tightly fitted into the inner trunk portion 109, and the interior of the cylinder 9 above this inner trunk portion 109 is used as a pressurizing room 125. And in the lower end of the cylinder 9 a threaded trunk 129 having an inward flange 126 at the lower end thereof is threaded.

In this example, an aerosol-type valve 45 is provided in the peripheral wall 124 above said cylinder 9, and this aerosol-type valve 45 is one usually used in aerosol-type atomizer. Said aerosol-type valve 45 is, as illustrated for example in FIG. 12, constructed so as to envelope the valve body 66 with an outward flange 131 and the elastic member 67 with a first through-hole sealing the upper surface of the valve body 66 in the metallic casing 68 with a second through-hole, thereby connecting them to each other in one-piece, to insert the valve tube 71 with a closed lower end surface having an annular concave part with a valve hole 70 drilled at the middle portion thereof through said first and second through-holes, to fit the elastic member 67 into the annular concave part, to seal said valve hole 70 by means of the inner wall surface of the through-hole of this elastic member 67, to fit the depressing head 40 with the spraying aperture 43 into the upper end of the valve tube 71, and to energize the valve tube 71 upwards by means of the spring 72.

And when the depressing head 40 is depressed against energization, the peripheral portion of the through-hole of the elastic member 67 is bent downwards together with the lowered valve tube 71, thereby opening the valve hole 70, and when the valve tube 71 is raised due to the released depressing head, the elastic member 67 is also returned to the illustrated position, thereby sealing said valve hole 70. And the valve hole 70 and the elastic member 67 forms a discharge valve. Generally a suction pipe hanging from the through-hole **66*b* drilled in the bottom wall of the valve body 66 into the container body 1 is provided, in this example, however, the suction pipe may only communicate with the interior of the pressurizing room 125 formed of the valve body 60 and the interior of the cylinder above the inner trunk portion 109. In addition to the valve 45 illustrated, there is also another arrangement wherein the elastic member 67 is adapted not to be bent, the valve hole 70 is moved out of the inner wall surface of the through-hole of the elastic member 67 due to the lowered valve tube 71, thereby communicating the valve hole 70 with the interior of the valve body 66 in order to spray liquid out of the spraying aperture 43, and the valve tube 71 is raised again due to the push up effect of the spring 72 when the depressing head 40 is released, thereby sealing the valve hole 70 by means of the inner wall surface of the through-hole of the elastic member 67**.

Said cylinder 9 is energized downwards with respect to the inner trunk portion by means of a spring. In the example illustrated, the lower end of the spring 100 fitted loosely onto the inner trunk portion 109 of the main trunk member is pressed against the upper surface of the inward flange 126, and the upper end of the spring is pressed against the lower surface of the larger outer diameter portion of the inner trunk portion 109.

Due to the above-described arrangement of the present invention, liquid can be sucked into the interior of the pressurizing room 125 only by lifting up the cylinder 9 with respect to the outer trunk portion 107 and the inner trunk portion 109, and the depressing head 40 is depressed in this condition, spraying can be continued till the liquid in the interior of the pressurizing room 125 is completely sucked. In addition, a suction valve 7 is attached in the upper portion of the inner trunk portion 109, the cylinder 9 is water-tightly fitted onto the inner trunk portion 109, the Interior of the cylinder 9 above the inner trunk portion 109 is used as a pressurizing room 125, and a discharge valve 45 of said arrangement is provided above the pressurizing room 125, thereby allowing the pressurizing room a much higher compression ratio than that of the above-described conventional accumulator atomizer.

The aerosol-type valve member of Example 4 may be used in Example 7.

Every component part of the above-described apparatus can be molded of plastic. According to the designs of spraying apertures, an atomizer spraying liquid in an atomized pattern or a sprayer spraying liquid in a straight-line can be provided.

INDUSTRIAL APPLICATIONS

The present invention is applicable for atomizing or spraying various liquids, for example, as atomizers for cosmetic liquids, sprayers for shampoo liquids, atomizers for insecticides, atomizers for liquid detergents, etc.

We claim:

1. A liquid sprayer comprising:

a container body provided with a neck portion extending therefrom;

a one-piece cylinder hanging from said neck portion into the container body;

a suction valve provided at the lower end portion of the cylinder;

a suction pipe extending from the suction valve to the inner bottom of the container body;

an erecting wall having an upper end portion engaged with the upper portion of said cylinder, and being attached to the outer surface of said neck portion;

an erecting guide trunk connected to the lower end of the erecting wall, and surrounding the erecting wall from outside with a constant distance therefrom;

a trunk piston upwardly and downwardly movably fitted into said cylinder;

a stem extending from the piston;

a connecting piece attached to the upper end of the stem;

a sliding trunk hanging from the connecting piece and being upwardly and downwardly movably fitted into the gap between said erecting wall and guide trunk, wherein the sliding trunk stabilizes the stem to cause steady upward and downward movement of the stem as the sliding trunk moves upwardly and downwardly within the gap between the erecting wall and the guide trunk;

a head provided above said stem, and having a spraying aperture communicating with the interior of said stem; and a discharge valve provided in the upper portion of said stem.

2. The liquid sprayer of claim 1 wherein the sliding trunk is hung from the outer periphery of the connecting piece, the stem is one-piece with the connecting piece, the stem is one-piece with the sliding trunk, and the stem, connecting piece and sliding trunk are formed of plastic.

3. A liquid sprayer, comprising:

a container body provided with a neck portion extending therefrom;

a cylinder hanging from said neck portion into the container body;

a suction valve provided at the lower end portion of the cylinder;

a suction pipe extending from the suction valve to the inner bottom of the container body;

an erecting wall having an upper end portion engaged with the upper portion of said cylinder, and being attached to the outer surface of said neck portion;

an erecting guide trunk connected to the lower end of the erecting wall, and surrounding the erecting wall from outside with a constant distance therefrom;

a trunk piston upwardly and downwardly movably fitted into said cylinder;

a stem extending from the piston;

a connecting piece attached to the upper end of the stem;

a sliding trunk hanging from the connecting piece and being upwardly and downwardly movably fitted into the gap between said erecting wall and guide trunk, wherein the sliding trunk stabilizes the stem to cause steady upward and downward movement of the stem as the sliding trunk moves upwardly and downwardly within the gap between the erecting wall and the guide trunk;

a head provided above said stem, and having a spraying aperture communicating with the interior of said stem; and a discharge valve provided in the upper portion of said stem;

wherein said erecting wall 1) is threaded on the neck portion, 2) has an inwardly extending flange at the upper end thereof, 3) fixes the upper portion of the cylinder by clamping it between the inwardly extending flange and the upper end portion of said neck portion, and 4) has connected thereto an engaging trunk extending from the inner periphery of the inwardly extending flange into the cylinder.

4. A liquid sprayer comprising:

a container body provided with a neck portion extending therefrom;

a one-piece cylinder depending from said neck portion into the container body and defining a longitudinal direction and a radial direction; and a sliding trunk disposed between an erecting wall and a guide trunk that surrounds the erecting wall, the sliding trunk supporting a stem for movement within the cylinder;

wherein the neck portion is disposed radially outwardly from the cylinder, the erecting wall is disposed radially outwardly from the neck portion, the sliding trunk is disposed radially outwardly from the erecting wall, and the guide trunk is disposed radially outwardly from the sliding trunk.

5. The liquid sprayer of claim 4, wherein an upper end portion of the erecting wall is engaged with an upper portion of the cylinder.

6. The liquid sprayer of claim 5, wherein the erecting wall is attached to an outer surface of the neck portion.

7. The liquid sprayer of claim 4, wherein the erecting wall is attached to an outer surface of the neck portion.

8. The liquid sprayer of claim 4, further comprising:

a trunk piston upwardly and downwardly movably fitted into the cylinder, the stem extending from the piston; and a connecting piece which connects an upper end of the stem to the sliding trunk.

9. The liquid sprayer of claim 8, further comprising:

a head provided above the stem, having a spraying aperture communicating with the interior of the stem; and a discharge valve provided in the upper portion of said stem.

10. A liquid sprayer, comprising:

a container body provided with a neck portion extending therefrom;

a cylinder depending from said neck portion into the container body and defining a longitudinal direction and a radial direction; and a sliding trunk disposed between an erecting wall and a guide trunk that surrounds the erecting wall, the sliding trunk supporting a stem for movement within the cylinder;

wherein the neck portion is disposed radially outwardly from the cylinder, the erecting wall is disposed radially outwardly from the neck portion, the sliding trunk is disposed radially outwardly from the erecting wall, and the guide trunk is disposed radially outwardly from the sliding trunk;

wherein the erecting wall 1) is threaded on the neck portion, 2) has an inwardly extending flange at an upper end thereof, 3) fixes the upper portion of the cylinder by clamping it between the inwardly extending flange and an upper end portion of the neck portion, and 4) has connected thereto an engaging trunk extending from the inner periphery of the inwardly extending flange into the cylinder.

* * * * *

UNITED STATES PATENT AND TRADEMARK OFFICE

CERTIFICATE OF CORRECTION

PATENT NO. : 5,346,103

DATED : September 13, 1994

INVENTOR(S) : Hiroshi Mizushima, Tadao Saito, Takamitsu Nozawa

It is certified that error appears in the above-indentified patent and that said Letters Patent is hereby corrected as shown below:

On the title page, in Item [73], after "abandoned", insert --, filed as PCT/JP90/01298 --.

Signed and Sealed this

Sixth Day of June, 1995

Bruce Lehman

*Attest:*

BRUCE LEHMAN

*Attesting Officer*

*Commissioner of Patents and Trademarks*